US007369095B2

(12) United States Patent
Hirtzlin et al.

(10) Patent No.: US 7,369,095 B2
(45) Date of Patent: May 6, 2008

(54) SOURCE-ANTENNAS FOR TRANSMITTING/RECEIVING ELECTROMAGNETIC WAVES

(75) Inventors: Patrice Hirtzlin, Rennes (FR); Ali Louzir, Rennes (FR); Jean-François Pintos, Pacé (FR); Franck Thudor, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 160 days.

(21) Appl. No.: 11/034,307

(22) Filed: Jan. 12, 2005

(65) Prior Publication Data

US 2005/0200553 A1 Sep. 15, 2005

Related U.S. Application Data

(63) Continuation of application No. 09/874,340, filed on Jun. 5, 2001, now abandoned.

(30) Foreign Application Priority Data

Jun. 9, 2000 (FR) ..... 00 07424

(51) Int. Cl.
*H01Q 1/36* (2006.01)
*H01Q 21/00* (2006.01)

(52) U.S. Cl. ..... 343/853; 343/895

(58) Field of Classification Search ..... 343/853, 343/895

See application file for complete search history.

(56) References Cited

U.S. PATENT DOCUMENTS

| | | | | |
|---|---|---|---|---|
| 4,165,454 A | | 8/1979 | Carlsson et al. | |
| 4,460,899 A | | 7/1984 | Schmidt et al. | |
| 4,559,539 A | | 12/1985 | Markowitz et al. | |
| 5,231,406 A | | 7/1993 | Sreenivas | |
| 5,757,323 A | * | 5/1998 | Spencer | 343/700 MS |
| 5,986,619 A | | 11/1999 | Grybos et al. | |
| 6,329,954 B1 | * | 12/2001 | Fuchs et al. | 343/725 |
| 6,396,440 B1 | * | 5/2002 | Chen | 343/700 MS |

FOREIGN PATENT DOCUMENTS

| | | |
|---|---|---|
| DE | 3927141 | 7/1990 |
| EP | 507307 | 10/1992 |
| GB | 2227369 | 7/1990 |
| WO | WO 99/35711 | 7/1999 |

OTHER PUBLICATIONS

EPO Search Dated Aug. 31, 2001.
French Search Dated Feb. 15, 2001.

* cited by examiner

*Primary Examiner*—Michael C. Wimer
(74) *Attorney, Agent, or Firm*—Joseph J. Laks; Robert D. Shedd; Brian J. Cromarty

(57) ABSTRACT

The present invention relates to a source-antenna for transmitting/receiving electromagnetic waves comprising an array of n radiating elements ($\mathbf{11}_3$, $\mathbf{11}_4$) operating in a first frequency band, means (20) with longitudinal radiation operating in a second frequency band, the array and the means with longitudinal radiation having a substantially common phase centre, the n radiating elements being arranged symmetrically about the longitudinal-radiation means, and each element ($\mathbf{11}_3$, $\mathbf{11}_4$) of the array consisting of a radiating element of the travelling wave type.

12 Claims, 2 Drawing Sheets

SOURCE-ANTENNAS FOR TRANSMITTING/RECEIVING ELECTROMAGNETIC WAVES

This application is a continuation of U.S. application No. 09/874,340, filed on Jun. 5, 2001 now abandoned.

FIELD OF THE INVENTION

The present invention relates to an improvement to source-antennas for transmitting/receiving electromagnetic waves, more particularly to the devices of this type used for satellite communication systems in the C band, in the Ku band or in the Ka band.

BACKGROUND OF THE INVENTION

Interactive wireless telecommunication services are developing ever more rapidly. These services relate in particular to telephony, telefax, television, the Internet network and any so-called multimedia domain. The equipment for these general-broadcast services have to be available at reasonable cost. This is true in particular for the user's transmission/reception system which has to communicate with a server, usually by way of a telecommunication satellite. In this case, the communications are performed in the microwave frequency domain, especially in the C, Ku or Ka bands, that is to say at frequencies lying between 4 GHz and 30 GHz.

For the transmission (T)/reception (R) source antennas, use is usually made of waveguide devices generally comprising a wide frequency band corrugated horn so as to cover the two bands, transmission and reception, this horn being associated with a device allowing the separation of the transmission and reception paths and/or the orthogonal polarizations and which consist of an orthomode (or Ortho-Mode Transducer: OMT) and of waveguide filters on each of the ports.

The implementational technology is unwieldy and expensive. Its weight and bulk are generally incompatible with use by individuals.

Thus, the applicant has already proposed in Patent WO99/35711 in the name of THOMSON Multimedia a transmission/reception source-antenna situated at the focus of a focusing system, such as a spherical lens, a parabolic-reflector antenna or a multireflector antenna, which may be used in home terminals for satellite communication systems. In this case, the source-antenna used for illuminating the lens or the parabolic reflector consists of an array of N radiating elements, i.e. of N patches for one direction of link such as reception and of a longitudinal-radiation antenna such as a helix, a dielectric rod, with axis coinciding with the axis of radiation or any other type of longitudinal-radiation antenna for the other direction of link for example transmission, this antenna being situated at the centre of the array. Thus the phase centres of the longitudinal-radiation antenna and of the array of patches practically coincide and can be placed at the focus of the system of antennas.

In order for this type of mixed source to ensure maximum decoupling between the array of N radiating elements of patch type and the longitudinal-radiation antenna such as a helix, it is preferable for the array of patches to be used for the link effected at low frequency, i.e. in reception, and for the longitudinal-radiation antenna to be used for the link effected at high frequency, i.e. in transmission.

However, the reception frequency band generally being wider than the transmission frequency band and the link budget being more sensitive to losses of the reception source, the choice of an array of patches for the reception source is not optimal from this point of view.

Moreover, with an array of patches, it is often difficult to obtain circular polarization of good quality throughout the reception band. However, most communication systems using low-orbit satellites operate with circular polarizations.

The aim of the present invention is therefore to propose an optimal solution to the problems hereinabove, in the case of satellite communication systems using circular polarizations.

SUMMARY OF THE INVENTION

Accordingly, the subject of the present invention is a source-antenna for transmitting/receiving electromagnetic waves comprising an array of n radiating elements operating in a first frequency band and an element with longitudinal radiation operating in a second frequency band and situated at the centre of the array, the array with n radiating elements and the element with longitudinal radiation having a substantially common phase centre, the n radiating elements being arranged symmetrically about the longitudinal-radiation element, characterized in that each element of the array consists of a radiating element of the travelling wave type.

According to a preferred embodiment, the radiating element of the travelling wave type is a helical device.

In this case, the length of each helix of the array with n elements will be the longitudinal-radiation element i.e. almost identical to that of the array.

The length of each helix is determined in a conventional manner knowing that, for correct operation of the helix in its longitudinal mode, the following typical relations must hold:

$$3/4<\Pi\times D/\lambda<4/3$$

$$0.6\ D<S<0.8\ D$$

with $\lambda$ the wavelength corresponding to the central frequency of operation of the helix, D the diameter of a turn and S the distance between two successive turns.

The number N' of turns, and hence the total length of the helix L=N'S, determines the directivity of the helix. The width of the main beam of the radiation pattern is given by the following typical relation:

$$\theta°=52/\sqrt{(N'S/\lambda)}$$

where $\theta°$ is the width of the beam at 3 dB.

The use of radiating devices of the travelling wave type, more particularly of helical devices, exhibits a certain number of advantages. Thus, it makes it possible to restrict the array losses, the helical devices exhibiting very low losses. Consequently, the losses from the array-antenna are limited almost to the losses from the feed array. Moreover, they afford a solution to the problems of choosing the substrate. Specifically, in the case of patch-type antennas, compromises are necessary between the demands of circuits requiring a slender substrate with high dielectric permittivity and those of the antennas requiring a thick substrate with low permittivity.

Moreover, the use of a helical device as elementary radiating element for the array makes it possible by virtue of its intrinsic radiation under circular polarization and of its operation over a wide frequency band to afford a solution to the problems of width of bands and of circular polarization of the source-antenna.

Furthermore, when the n radiating elements are positioned using the technique of sequential rotation for the array, the use of a helix as elementary radiating element makes it possible to simplify the topology of the feed array, thus restricting its losses and its bulk.

According to another characteristic of the present invention, the longitudinal-radiation element comprises a longitudinal-radiation dielectric rod with axis coinciding with the axis of radiation or a helical device with axis coinciding with the axis of radiation. In the case of a dielectric rod, the longitudinal-radiation element is excited by means comprising a waveguide.

According to yet another characteristic of the present invention, one of the two frequency bands is used for the reception of electromagnetic waves whilst the other frequency band is used for the transmission of electromagnetic waves.

Thus, the invention can be used in the case of low-frequency/high-frequency inversion.

BRIEF DESCRIPTION OF THE DRAWINGS

Other characteristics and advantages of the present invention will become apparent on reading the following description of various preferred embodiments, this description being given with reference to the herein-appended drawings in which.

To simplify the description, in the drawings, the same elements bear the same references.

DESCRIPTION OF PREFERRED EMBODIMENTS

Figure 1:
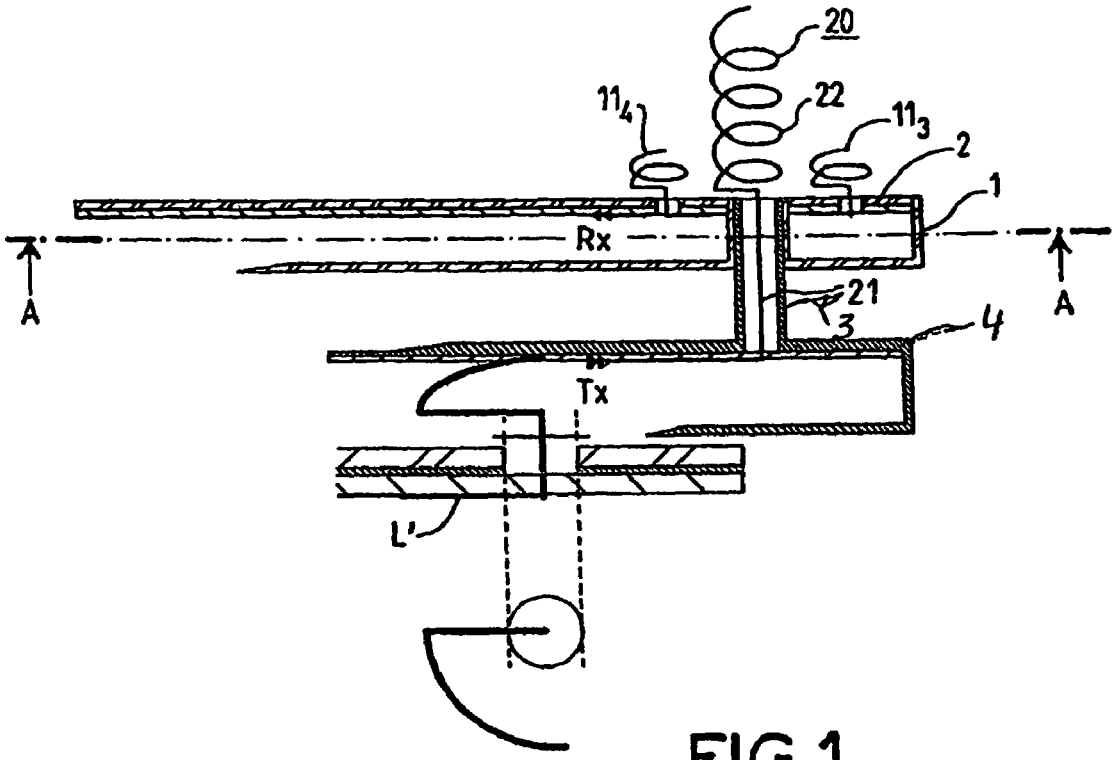
FIG. 1 is a sectional view of a first embodiment of a source-antenna for transmitting/receiving electromagnetic waves in accordance with the present invention.
Figure 4:
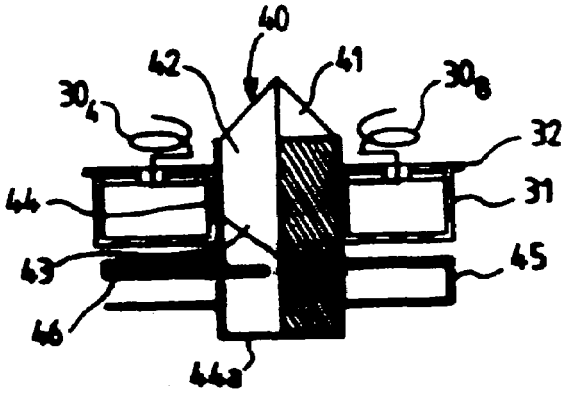
FIG. 4 is a sectional view of another embodiment of a source-antenna for transmitting/receiving magnetic waves in accordance with the present invention.

As represented more particularly in FIGS. 1 and 4, the source-antenna is a mixed source comprising a first array of n radiating elements operating in a first frequency band more particularly in reception and a longitudinal-radiation antenna operating in a second frequency band, i.e. in transmission.

As represented in FIG. 1, the first array of n radiating elements consists of a support 1 of parallelepipedal shape, covered on its upper face with a substrate 2 made of dielectric materials.

Figure 2:
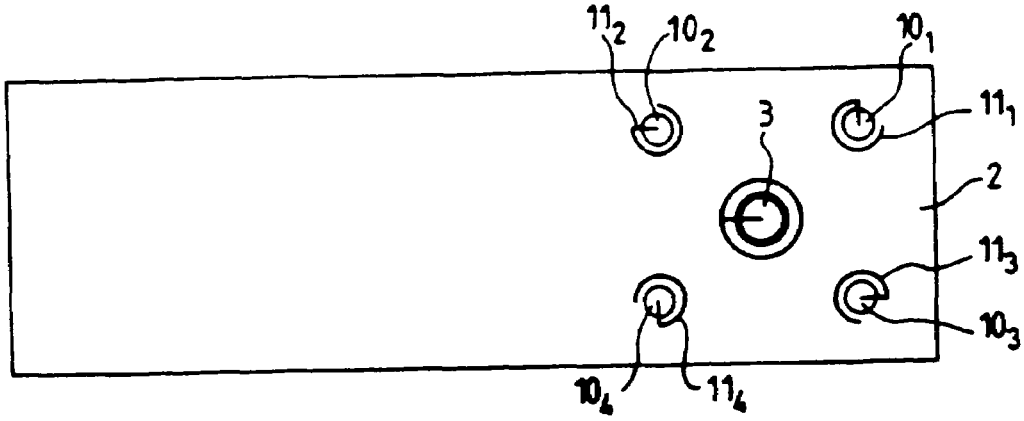
FIG. 2 is a view from above of the source-antenna of FIG. 1.

As represented clearly in FIG. 2, the support 1 comprises four circular holes $\mathbf{10}_1$, $\mathbf{10}_2$, $\mathbf{10}_3$, $\mathbf{10}_4$, which, in the embodiment represented, are positioned at the four vertices of a square. These four holes allow the passage of four radiating elements consisting of helices $\mathbf{11}_1$, $\mathbf{11}_2$, $\mathbf{11}_3$, $\mathbf{11}_4$. Provided at the middle of the square is a circular aperture allowing the passage of a fastening stem which forms part of the support element of the longitudinal-radiation antenna which will be described subsequently. The circular aperture is positioned at the centre of the square bounded by the orifices $\mathbf{10}_1$, $\mathbf{10}_2$, $\mathbf{10}_3$, $\mathbf{10}_4$ allowing the passage of four radiating elements as described hereinabove.

Figure 3:
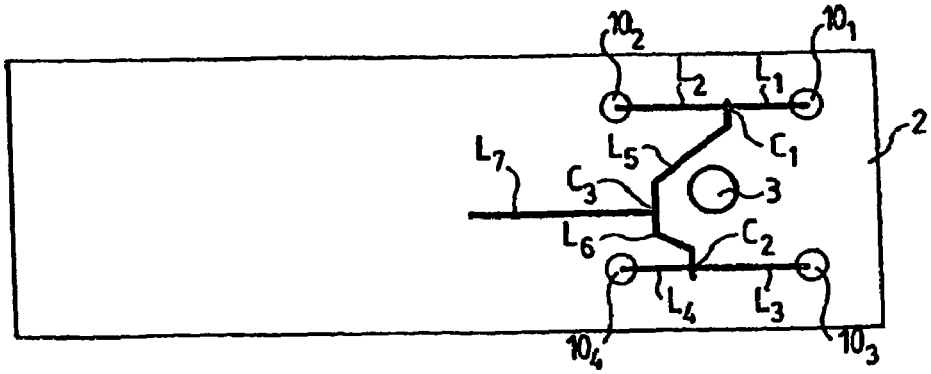
FIG. 3 is a sectional view along A-A of FIG. 1, representing the topology of the feed circuit of the array of helices.

As represented in FIG. 2, the helical devices $\mathbf{11}_1$, $\mathbf{11}_2$, $\mathbf{11}_3$, $\mathbf{11}_4$ are positioned in such a way as to form a sequential-rotation array. Moreover, as represented in FIG. 1, the helical devices $\mathbf{11}_1$, $\mathbf{11}_2$, $\mathbf{11}_3$, $\mathbf{11}_4$ exhibit a small length l. Furthermore, as represented in FIG. 3, the helices $\mathbf{11}_1$, $\mathbf{11}_2$, $\mathbf{11}_3$, $\mathbf{11}_4$ are connected to a feed array made in printed technology on the rear face of the substrate 2. In a known manner, the feed array consists of microstrip lines L1, L2, L3, L4, L5, L6, L7. More specifically, the lines L1 and L2 connect the antennas $\mathbf{11}_1$ and $\mathbf{11}_2$ with the point of connection C1, the lines L2 and L4 connect the antennas $\mathbf{11}_3$ and $\mathbf{11}_4$ with the point of connection C2, the line L5 connects the point C1 to the point C3 and the line L6 connects the point C2 to the point C3, the line L7 being connected between the excitation circuit and the point of connection C3. To obtain a sequential rotation, the values Li satisfy the relations:

$$L5-L6=\lambda g/2$$

$$L2-L1=L3-L4=\lambda g/4$$

where λg represents the guided wavelength in the microstrip line at the central frequency of operation. Thus, the relative excitation phases of the helices $\mathbf{11}_2$, $\mathbf{11}_1$, $\mathbf{11}_3$, $\mathbf{11}_4$ are respectively 0°, 90°, 180° and 270°. If the helices are turned sequentially about their axis by an angle of 0°, 90°, 180° and 270° respectively, the conditions of the sequential rotation are ensured in the present case for a right circular polarization. For left circular polarization, the sequential rotation is obtained by turning the helices by 0°, −90°, −180° and −270° respectively.

The embodiment represented relates to an array of radiating elements comprising four helices. However, as will be described subsequently, the array of radiating elements can comprise for example eight helices regularly distributed over a circle of diameter 1.7 λ0.

As represented in FIG. 1, associated with this array of four helices operating in a first frequency band which is used in reception is a longitudinal-radiation means operating in a second frequency band. In the embodiment of FIG. 1, this means consists of a helix 20 connected by a coaxial cable 21 passing inside the stem 3 to an excitation circuit described subsequently. The helix 20 is composed of a set of turns 22 and operates in axial mode. The right circular section of the helix is therefore restricted to roughly the wavelength divided by three. More specifically, it has to satisfy the relation $3/4<\Pi\times D/\lambda<4/3$ where D is the diameter of the helix.

The stem 3 forms part of a support 4 of parallelepipedal shape made from a conducting material, the support 4 being intended to receive the excitation circuit.

This circuit consists of a single microstrip line L' etched on the substrate and whose characteristic impedance is equal to that of the helix adapted by the stretch of coaxial line (the stem) to ensure good matching.

In a known manner, the lines L7 and L' are connected respectively in the embodiment represented to a circuit for receiving and to a circuit for transmitting electromagnetic waves, these circuits comprising amplifiers and frequency converters. According to a variant of the present invention, the reception and transmission circuits may be inverted, i.e. the long-helix antenna is used in reception and the array in transmission.

Figure 5:
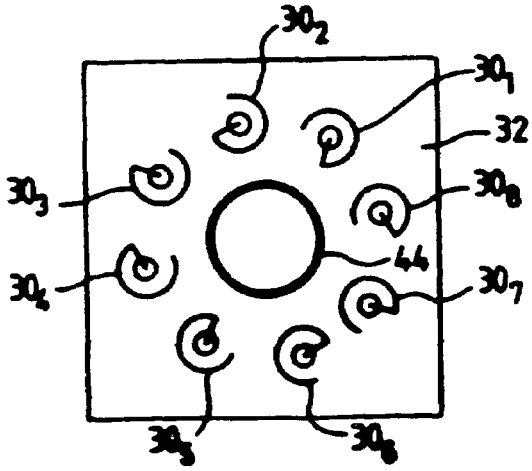
FIG. 5 is a view from above of the antenna of FIG. 4.

Another embodiment of a transmission/reception source-antenna according to the present invention will now be described with reference to FIGS. 4 and 5. In this case, the reception circuit consists, as for the first embodiment, of an array of n radiating elements operating in a first frequency band, i.e. of an array of eight helices, $30_1$, $30_2$, $30_3$ . . . $30_8$ which are positioned on a circle of diameter 1.7 λ0 approximately. Depending on the desired directivity, the diameter of this circle can be modified. The use of eight radiating elements makes it possible to obtain more directional radiation of the array and this embodiment is suitable for illuminating a double-reflector antenna. The helices $30_1$ to $30_8$ are fed in such a way as to obtain a sequential rotation. They are connected to a feed array (not represented) made in printed technology. In the embodiment of FIGS. 4 and 5, the longitudinal-radiation means consists of an element comprising a longitudinal-radiation dielectric rod with axis coinciding with the axis of radiation. More specifically, as represented in FIG. 4, the longitudinal-radiation means comprise a rod 40 emerging above a support body 31. The vertex of the cone 41 points towards the space towards which the waves radiate or from which they are picked up. This cone 41 is extended at its base by a cylinder 42 and terminates in a cone 43 whose vertex points in the opposite direction to that of the cone 41.

The rod 40 formed of the cone 41, of the cylinder 42 and of the cone 43 comprises for example compressed polystyrene constituting a longitudinal-radiation dielectric antenna, i.e. one exhibiting a relatively slender radiation pattern. This type of antenna is referred to as a "polyrod".

The configuration of the rod 40 explains its name of cylindro-conical antenna. The rod 40 operates as a waveguide and the mode which it transmits is such that the maximum radiation can appear on the axis of the direction of the rod 40. According to a variant which is not represented, the rod 40 is hollow. The technique for producing such dielectric antennas is well known to the person skilled in the art and will not be described in greater detail.

As represented in FIG. 4, the rod 40 is surrounded at the base of the cone 41 by a cylindrical stem 44 with axis coinciding with the axis of the rod 40. The aperture 44 passes inside the support body 31 as well as inside a body 45 of parallelepipedal shape made from a conducting material. The stem 44 is made from a conducting material and forms a waveguide whose walls are in contact with the body 45.

The upper part of the stem 44 emerging from the upper face of the body 31 is open whereas the lower part of the stem 44 emerging from the body 45 is closed by a metal plate 44*a*, the stem thus forming a resonant cavity. The stem 44 exhibits a perpendicular aperture allowing the passage of a substrate plate 46 receiving the electromagnetic wave reception or transmission circuit made in microstrip technology. The substrate-forming plate 46 is constructed from a material of given dielectric permittivity such as Teflon glass for example. It exhibits an upper face directed towards the rod 40 and a metallized lower face forming an earth plane. It is in contact with the conducting walls of the stem 44. The plate 46 is fed in a known manner by probes etched on the upper surface of the plate 46. The embodiment operates in an identical manner to the first embodiment.

What is claim is:

1. Source-antenna for transmitting/receiving electromagnetic waves comprising on a support an array of n independent radiating elements operating in a first frequency band for receiving or transmitting electromagnetic waves, and an element with longitudinal radiation operating in a second frequency band for transmitting or receiving electromagnetic waves and situated at the center of the array, said longitudinal radiation element having an axis of radiation and each independent radiating element having an own radiating axis, said radiating axis being different for each independent radiating element and different from the axis of radiation of the longitudinal radiation element, the array of n radiating elements and the element with longitudinal radiation having a substantially common phase center, the n radiating elements being arranged symmetrically about the longitudinal-radiation element, wherein each radiating element of the array consists of a traveling wave antenna and the dimensions of the radiating elements of the array being calculated to obtain a radiation pattern equivalent to the radiation pattern of the element with longitudinal radiation.

2. Source-antenna according to claim 1, characterized in that the traveling wave antenna is a helix.

3. Source-antenna according to claim 2, characterized in that the length of the helix is calculated in such a way that the radiation pattern of the array is substantially identical to the radiation pattern of the said helix.

4. Source-antenna according to claim 2, characterized in that the helixes are arranged so as to form a sequential-rotation array.

5. Source-antenna according to claim 1, characterized in that the array of n radiating elements is excited by a feed array made in printed technology.

6. Source-antenna according to claim 1, characterized in that n is equal to 4.

7. Source-antenna according to claim 1, characterized in that n is equal to 8.

8. Source-antenna according to claim 1, characterized in that the longitudinal-radiation element comprises a longitudinal-radiation dielectric rod.

9. Source-antenna according to claim 1, characterized in that the longitudinal-radiation element comprises a helix with axis coinciding.

10. Source-antenna according to claim 7, characterized in that the longitudinal-radiation element is excited by means comprising a wave guide.

11. Source-antenna according to claim 8, characterized in that the longitudinal-radiation element is excited by means comprising a wave guide.

12. Source-antenna according to claim 1, characterized in that one of the two frequency bands is used for the reception of electromagnetic waves whilst the other frequency band is used for the transmission of electromagnetic waves.

* * * * *